US010444661B2

(12) United States Patent
Cavill et al.

(10) Patent No.: US 10,444,661 B2
(45) Date of Patent: Oct. 15, 2019

(54) TONER CARTRIDGE HAVING A BIASING ASSEMBLY FOR BIASING A MEDIA FEED ROLL IN AN ELECTROPHOTOGRAPHIC IMAGE FORMING DEVICE

(71) Applicant: LEXMARK INTERNATIONAL, INC., Lexington, KY (US)

(72) Inventors: Gregory Alan Cavill, Winchester, KY (US); Jason Paul Hale, Pembroke Pines, FL (US); James Richard Leemhuis, Lexington, KY (US); David Lee Merrifield, Lexington, KY (US); Matthew Lee Rogers, Lexington, KY (US); Daniel Lee Thomas, Lexington, KY (US); Randal Scott Williamson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/790,433

(22) Filed: Oct. 23, 2017

(65) Prior Publication Data

US 2019/0121256 A1 Apr. 25, 2019

(51) Int. Cl.
*G03G 15/08* (2006.01)
*G03G 21/18* (2006.01)

(52) U.S. Cl.
CPC ..... *G03G 15/0834* (2013.01); *G03G 15/0896* (2013.01); *G03G 21/1853* (2013.01); *G03G 2215/066* (2013.01)

(58) Field of Classification Search
CPC ..... G03G 15/0834; G03G 15/0896; G03G 21/1853; G03G 2215/066
See application file for complete search history.

(56) References Cited

U.S. PATENT DOCUMENTS

| | | | | |
|---|---|---|---|---|
| 6,064,843 | A * | 5/2000 | Isobe | G03G 21/1825 399/111 |
| 6,185,390 | B1 * | 2/2001 | Higeta | G03G 21/1867 399/111 |
| 6,415,119 | B2 | 7/2002 | Nishimura et al. | |
| 7,298,989 | B2 | 11/2007 | Nishimura | |
| 8,867,966 | B2 | 10/2014 | Acosta et al. | |
| 8,948,660 | B2 | 2/2015 | Baker et al. | |
| 9,008,536 | B2 * | 4/2015 | Hashimoto | G03G 15/0194 399/390 |
| 9,104,141 | B2 | 8/2015 | Buchanan et al. | |
| 9,291,989 | B1 | 3/2016 | Carpenter et al. | |

(Continued)

OTHER PUBLICATIONS

U.S. Appl. No. 15/790,418, filed Oct. 23, 2017 (Cavill et al.).

(Continued)

*Primary Examiner* — Hoang X Ngo

(57) ABSTRACT

A toner cartridge according to one example embodiment includes a housing having a reservoir for holding toner and an outlet in fluid communication with the reservoir for exiting toner from the toner cartridge. A resiliently deflectable cam is positioned on an exterior portion of the housing to contact a media feed roll assembly when the toner cartridge is installed in the image forming device for biasing the media feed roll assembly into contact with a corresponding media feed roll in the image forming device to form a media feed nip in the image forming device.

11 Claims, 14 Drawing Sheets

(56) References Cited

U.S. PATENT DOCUMENTS

| | | | | |
|---|---|---|---|---|
| 2006/0193652 | A1 | 8/2006 | Sato | |
| 2007/0048008 | A1 * | 3/2007 | Kamimura | G03G 21/1814 399/111 |
| 2009/0324314 | A1 | 12/2009 | Tanabe et al. | |
| 2012/0183326 | A1 | 7/2012 | Watanabe | |

OTHER PUBLICATIONS

U.S. Appl. No. 15/790,445, filed Oct. 23, 2017 (Hale et al.).
Non-Final Office Action dated Apr. 2, 2018 for U.S. Appl. No. 15/790,418 (Cavill et al.).
Non-Final Office Action dated May 14, 2018 for U.S. Appl. No. 15/790,445 (Hale et al.).
Final Office Action dated Oct. 11, 2018 for U.S. Appl. No. 15/790,418 (Cavill et al.).

* cited by examiner

TONER CARTRIDGE HAVING A BIASING ASSEMBLY FOR BIASING A MEDIA FEED ROLL IN AN ELECTROPHOTOGRAPHIC IMAGE FORMING DEVICE

CROSS REFERENCES TO RELATED APPLICATIONS

None.

BACKGROUND

1. Field of the Disclosure

The present disclosure relates generally to an electrophotographic image forming device and more particularly to a toner cartridge having a biasing assembly for biasing a media feed roll in an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) at a toner transfer nip either directly by the photoconductive drum or indirectly by an intermediate transfer member. The toner is then fused to the media using heat and pressure to complete the print.

Rotatable media feed rolls are positioned along a media path in the image forming device for advancing the print media from a media input tray, through the image forming device for printing and to an output location. It is desired to precisely locate the media as it passes through the toner transfer nip in order to provide accurate placement of toner on the print media.

SUMMARY

A toner cartridge according to one example embodiment includes a housing having a reservoir for holding toner and an outlet in fluid communication with the reservoir for exiting toner from the toner cartridge. A resiliently deflectable cam is positioned on an exterior portion of the housing to contact a media feed roll assembly when the toner cartridge is installed in the image forming device for biasing the media feed roll assembly into contact with a corresponding media feed roll in the image forming device to form a media feed nip in the image forming device.

A toner cartridge according to another example embodiment includes a housing having a top, a bottom, a front and a rear positioned between a first side and a second side of the housing. The housing has a reservoir for holding toner. An outlet in fluid communication with the reservoir is positioned on the front of the housing for exiting toner from the toner cartridge. A projection from an exterior portion of the front of the housing near the bottom of the housing is positioned to contact a media feed roll assembly when the toner cartridge is installed in the image forming device for biasing the media feed roll assembly into contact with a corresponding media feed roll in the image forming device to form a media feed nip in the image forming device.

An imaging system for an electrophotographic image forming device according to one example embodiment includes a toner cartridge removable from the image forming device. The toner cartridge includes a housing having a reservoir for holding toner. An outlet on the housing of the toner cartridge is in fluid communication with the reservoir for exiting toner from the toner cartridge. An engagement member is positioned on an exterior portion of the housing of the toner cartridge. An imaging unit is matable with the toner cartridge when the toner cartridge and the imaging unit are installed in the image forming device and removable from the image forming device separately from the toner cartridge. The imaging unit includes a housing and an inlet on the housing of the imaging unit positioned to receive toner from the outlet of the toner cartridge when the toner cartridge is mated with the imaging unit. A rotatable media feed roll is mounted on the housing of the imaging unit. When the toner cartridge mates with the imaging unit with the toner cartridge and the imaging unit installed in the image forming device, the engagement member of the toner cartridge moves the media feed roll of the imaging unit relative to the housing of the imaging unit from a retracted position of the media feed roll to an operative position of the media feed roll where the media feed roll mates with a corresponding media feed roll in the image forming device to form a media feed nip with the corresponding media feed roll in the image forming device.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
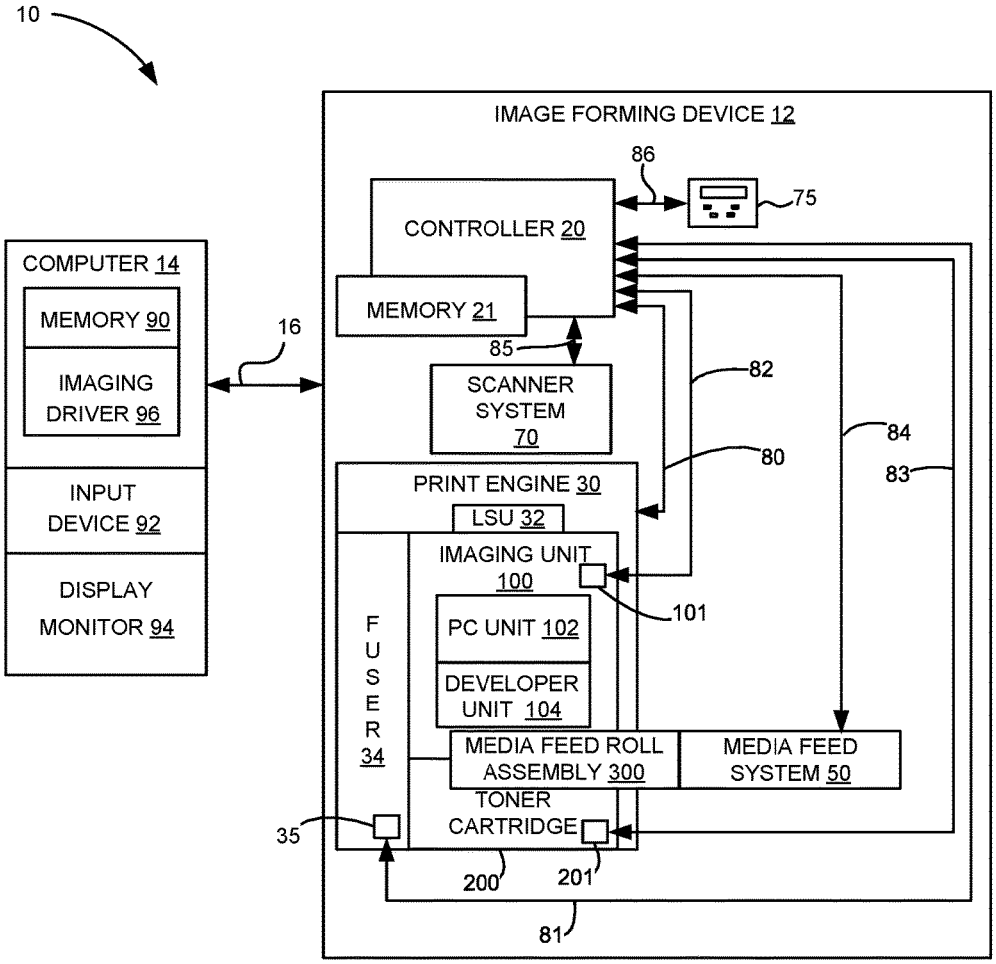
FIG. 1 is a block diagram of an imaging system having an image forming device according to one example embodiment.

Referring now to the drawings and particularly to FIG. 1, there is shown a block diagram depiction of an imaging system 10 according to one example embodiment. Imaging system 10 includes an image forming device 12 and a computer 14. Image forming device 12 communicates with computer 14 via a communications link 16. As used herein, the term "communications link" generally refers to any structure that facilitates electronic communication between multiple components and may operate using wired or wireless technology and may include communications over the Internet.

In the example embodiment shown in FIG. 1, image forming device 12 is a multifunction machine (sometimes referred to as an all-in-one (AIO) device) that includes a controller 20, a print engine 30, a laser scan unit (LSU) 32, an imaging unit 100, a toner cartridge 200, a user interface 75, a media feed system 50 and a scanner system 70. Image forming device 12 may communicate with computer 14 via a standard communication protocol, such as, for example, universal serial bus (USB), Ethernet or IEEE 802.xx. Image forming device 12 may be, for example, an electrophotographic printer/copier including an integrated scanner system 70 or a standalone electrophotographic printer.

Controller 20 includes a processor unit and associated electronic memory 21. The processor may include one or more integrated circuits in the form of a microprocessor or central processing unit and may be formed as one or more Application-specific integrated circuits (ASICs). Memory 21 may be any volatile or non-volatile memory or combination thereof, such as, for example, random access memory (RAM), read only memory (ROM), flash memory and/or non-volatile RAM (NVRAM). Memory 21 may be in the form of a separate memory (e.g., RAM, ROM, and/or NVRAM), a hard drive, a CD or DVD drive, or any memory device convenient for use with controller 20. Controller 20 may be, for example, a combined printer and scanner controller.

In the example embodiment illustrated, controller 20 communicates with print engine 30 via a communications link 80. Controller 20 communicates with imaging unit 100 and processing circuitry 101 thereon via a communications link 82. Controller 20 communicates with toner cartridge 200 and processing circuitry 201 thereon via a communications link 83. Controller 20 communicates with a fuser 34 and processing circuitry 35 thereon via a communications link 81. Controller 20 communicates with media feed system 50 via a communications link 84. Controller 20 communicates with scanner system 70 via a communications link 85. User interface 75 is communicatively coupled to controller 20 via a communications link 86. Controller 20 processes print and scan data and operates print engine 30 during printing and scanner system 70 during scanning. Processing circuitry 101, 201, 35 may provide authentication functions, safety and operational interlocks, operating parameters and usage information related to imaging unit 100, toner cartridge 200 and fuser 34, respectively. Each of processing circuitry 101, 201, 35 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 101, 201, 35.

Computer 14, which is optional, may be, for example, a personal computer, including electronic memory 90, such as RAM, ROM, and/or NVRAM, an input device 92, such as a keyboard and/or a mouse, and a display monitor 94. Computer 14 also includes a processor, input/output (I/O) interfaces, and may include at least one mass data storage device, such as a hard drive, a CD-ROM and/or a DVD unit (not shown). Computer 14 may also be a device capable of communicating with image forming device 12 other than a personal computer such as, for example, a tablet computer, a smartphone, or other electronic device.

In the example embodiment illustrated, computer 14 includes in its memory a software program including program instructions that function as an imaging driver 96, e.g., printer/scanner driver software, for image forming device 12. Imaging driver 96 is in communication with controller 20 of image forming device 12 via communications link 16. Imaging driver 96 facilitates communication between image forming device 12 and computer 14. One aspect of imaging driver 96 may be, for example, to provide formatted print data to image forming device 12, and more particularly to print engine 30, to print an image. Another aspect of imaging driver 96 may be, for example, to facilitate collection of scanned data from scanner system 70.

In some circumstances, it may be desirable to operate image forming device 12 in a standalone mode. In the standalone mode, image forming device 12 is capable of functioning without computer 14. Accordingly, all or a portion of imaging driver 96, or a similar driver, may be located in controller 20 of image forming device 12 so as to accommodate printing and/or scanning functionality when operating in the standalone mode.

Print engine 30 includes LSU 32, toner cartridge 200, imaging unit 100 and fuser 34, all mounted within image forming device 12. Imaging unit 100 is removably mounted in image forming device 12 and includes a developer unit 104 that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered uniform layer of toner on the surface of the developer roll. In another embodiment, the toner development system utilizes what is commonly referred to as a dual component development system. In this embodiment, toner in the toner reservoir of developer unit 104 is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, developer unit 104 includes a developer roll that attracts the magnetic carrier beads having toner thereon to the developer roll through the use of magnetic fields. Imaging unit 100 also includes a photoconductor unit ("PC unit") 102 that houses a photoconductive drum, a charging system and a waste toner removal system.

Toner cartridge 200 is removably mounted in image forming device 12 in a mating relationship with developer unit 104 of imaging unit 100. An outlet port on toner cartridge 200 communicates with an inlet port on developer unit 104 allowing toner to be periodically transferred from toner cartridge 200 to resupply the toner reservoir in developer unit 104.

The electrophotographic printing process is well known in the art and, therefore, is described briefly herein. During a printing operation, a charge roll in PC unit 102 electrically charges the outer surface of the photoconductive drum in PC unit 102 to a predetermined voltage. Laser scan unit 32 then discharges a selected portion of the outer surface of the photoconductive drum to create a latent image on the outer surface of the photoconductive drum. Toner is transferred from the toner reservoir in developer unit 104 to the latent image on the photoconductive drum by the developer roll to create a toned image on the outer surface of the photoconductive drum. The toned image is then transferred to a media sheet received by imaging unit 100 from a media input tray for printing. Toner remnants are removed from the photoconductive drum by the waste toner removal system. The toner image is bonded to the media sheet in fuser 34 and then sent to an output location or to one or more finishing options such as a duplexer, a stapler or a hole-punch.

In the present disclosure, one or more customer replaceable units of image forming device 12, such as imaging unit 100 and/or toner cartridge 200, includes a media feed roll assembly 300 having one or more media feed rolls that mate with corresponding media feed rolls of media feed system 50 in image forming device 12 when imaging unit 100 and/or toner cartridge 200 is installed in image forming device 12 to form one or more media feed nips therebetween.

Figure 2:
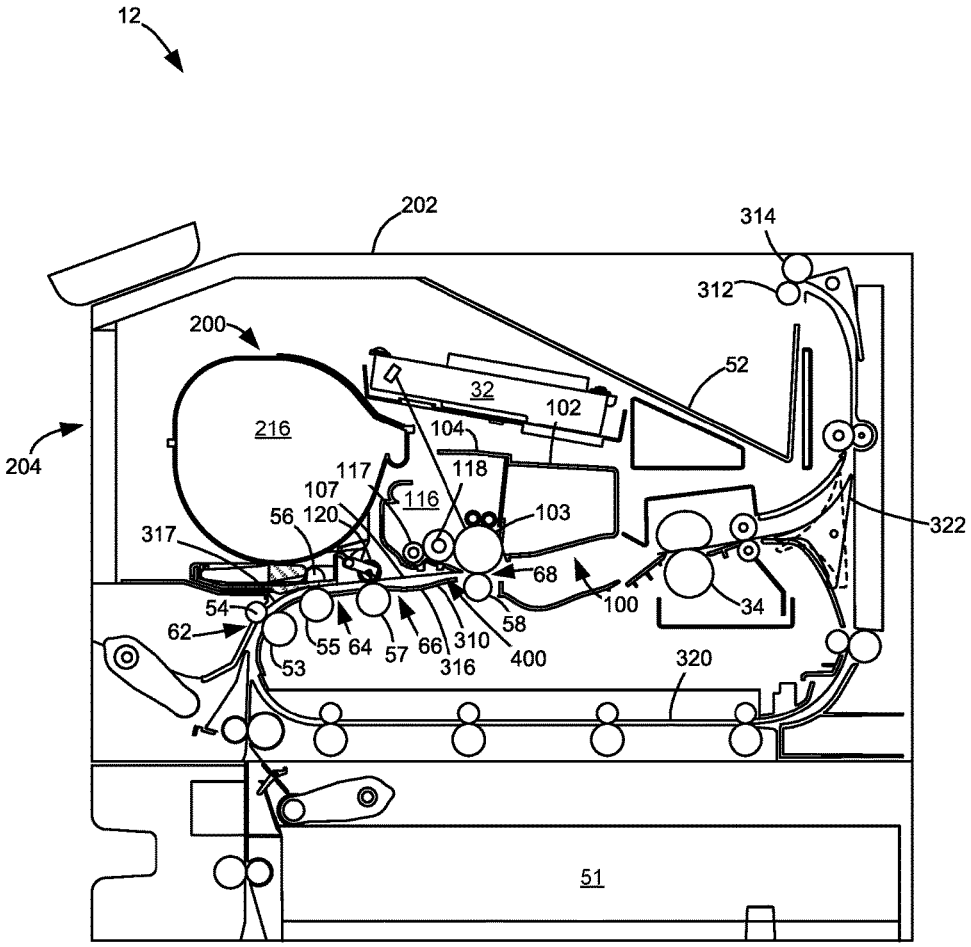
FIG. 2 is a schematic diagram of a media path of the image forming device according to one example embodiment.

FIG. 2 is a schematic diagram of image forming device 12 according to one example embodiment. Imaging unit 100 and toner cartridge 200 are shown installed in image forming device 12 in their operative positions. Image forming device 12 includes a housing 202 having an access door 204 that permits installation and removal of imaging unit 100 and toner cartridge 200 from image forming device 12. Toner cartridge 200 includes a toner reservoir 216 that stores toner for delivery to developer unit 104. In the example embodiment illustrated, developer unit 104 includes a toner reservoir 116 as well as a toner adder roll 117 that provides toner from toner reservoir 116 to a developer roll 118. Developer roll 118 is positioned to deliver toner to the latent image on a photoconductive drum 103 ("PC drum") of PC unit 102.

FIG. 2 illustrates a media path 400 of image forming device 12 according to one example embodiment. Media path 400 includes a simplex path 310 for printing on a first side of media sheets and may include a duplex path 320 for printing on a reverse side of a media sheet. Simplex path 310 of media path 400 extends from media input tray 51, past imaging unit 100 where the media receives toner from PC drum 103, to fuser 34 where the toner is bonded to the media and through a pair of rotatable redrive rolls 312, 314 which deliver the printed media to a media output area 52. Duplex path 320 of media path 400 extends from redrive rolls 312, 314, below simplex path 310 and merges with an entrance to simplex portion 310 from media input tray 51. If duplex printing is desired, upon receiving a printed media sheet from simplex path, redrive rolls 312, 314 rotate in reverse to deliver the printed media sheet to duplex path 320. During a duplex printing operation, the media is directed to duplex path 320 by a gate 322.

Media feed system 50 includes a series of media feed rolls 53, 54, 55, 56 and 57 as well as a toner transfer roll 58 positioned along media path 400 for moving media sheets along simplex path 310. Media feed rolls 53, 55, 57 and toner transfer roll 58 are mounted along a bottom guide surface 316 of simplex path 310 and media feed rolls 54 and 56 are mounted along a top guide surface 317 of simplex path 310. Media feed rolls 53 and 55 form media feed nips 62, 64 with media feed rolls 54 and 56, respectively. In the example embodiment illustrated, a bottom surface 107 of imaging unit 100 is positioned opposite bottom guide surface 316 and forms a portion of top guide surface 317 of simplex path 310 when imaging unit 100 is installed in image forming device 12. In the example embodiment illustrated, imaging unit 100 includes a media feed roll 120 that forms a media feed nip 66 with media feed roll 57 when imaging unit 100 and toner cartridge 200 are installed in image forming device 12 as discussed in greater detail below. In one example embodiment, media feed rolls 53, 55 and 57 are driven rolls and corresponding media feed rolls 54, 56 and 120 are backup rolls such that media feed rolls 54, 56 and 120 are rotated by their nip contact with driven media feed rolls 53, 55 and 57. When imaging unit 100 is installed in image forming device 12, PC drum 103 forms a toner transfer nip 68 with toner transfer roll 58 where toner is transferred from the surface of PC drum 103 to the media in simplex path 310.

Figure 3:
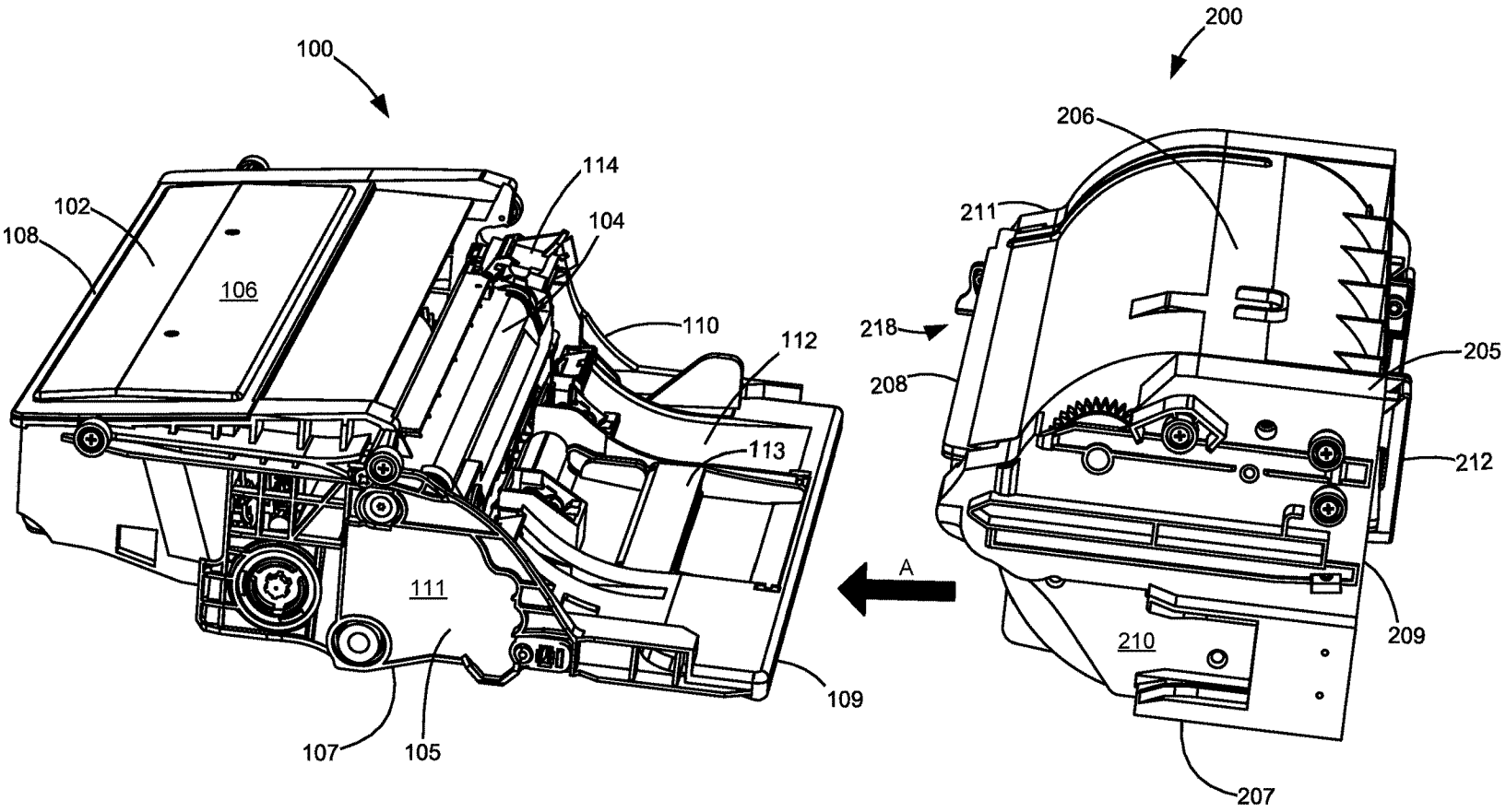
FIG. 3 is a perspective view of an imaging unit and a toner cartridge installable in the image forming device according to one example embodiment.

Referring now to FIG. 3, imaging unit 100 and toner cartridge 200 are shown according to one example embodiment. Toner cartridge 200 includes a housing 205 having an enclosed reservoir for storing toner. Housing 205 includes a top 206, a bottom 207, a front 208, a rear 209 and first and second sides 210, 211. Front 208 of housing 205 leads during insertion of toner cartridge 200 into image forming device 12 and rear 209 trails. An outlet port 218 in fluid communication with toner reservoir 216 is positioned facing downward on front 208 of housing 205 near side 211 for exiting toner from toner cartridge 200. A handle 212 may be provided on top 206 or rear 209 of housing 205 to assist with insertion and removal of toner cartridge 200 into and out of image forming device 12.

Imaging unit 100 includes a developer unit 104 mounted against PC unit 102. A handle frame 112 is attached to PC unit 102. Together, developer unit 104, PC unit 102 and handle frame 112 form a housing 105 of imaging unit 100. Housing 105 includes a top 106, a bottom 107, a front 108, a rear 109 and first and second sides 110, 111. Front 108 of housing 105 leads during insertion of imaging unit 100 into image forming device 12 and rear 109 trails. PC unit 102 is positioned at front 108 of housing 105 and handle frame 112 is positioned at rear 109 of housing 105. Developer unit 104 includes a toner inlet port 114 on top 106 of housing 105 near side 110 that is positioned to receive toner from toner cartridge 200. Toner received by inlet port 114 is stored in toner reservoir 116 (FIG. 2) of developer unit 104. A portion of the outer surface of PC drum 103 is exposed on bottom 107 of housing 105 (as shown in FIG. 4B). Toner on the outer surface of PC drum 103 is transferred from the portion of the outer surface of PC drum 103 that is exposed on bottom 107 of housing 105 to a media sheet during a print operation. Handle frame 112 includes a handle 113 exposed on housing 105 for user engagement to assist with insertion and removal of imaging unit 100 into and out of image forming device 12.

As discussed above, toner cartridge 200 and imaging unit 100 are each removably installable in image forming device 12. Imaging unit 100 is first slidably inserted into image forming device 12. Toner cartridge 200 is then inserted into image forming device 12 and onto handle frame 112 in a mating relationship with developer unit 104 of imaging unit 100 as indicated by the arrow A shown in FIG. 3, which also indicates the direction of insertion of toner cartridge 200 and imaging unit 100 into image forming device 12. This arrangement allows toner cartridge 200 to be removed and reinserted easily when replacing an empty toner cartridge 200 without having to remove imaging unit 100. Imaging unit 100 may also be readily removed as desired in order to maintain, repair or replace the components associated with developer unit 104, PC unit 102 or handle frame 112 or to clear a media jam.

Figure 4A:
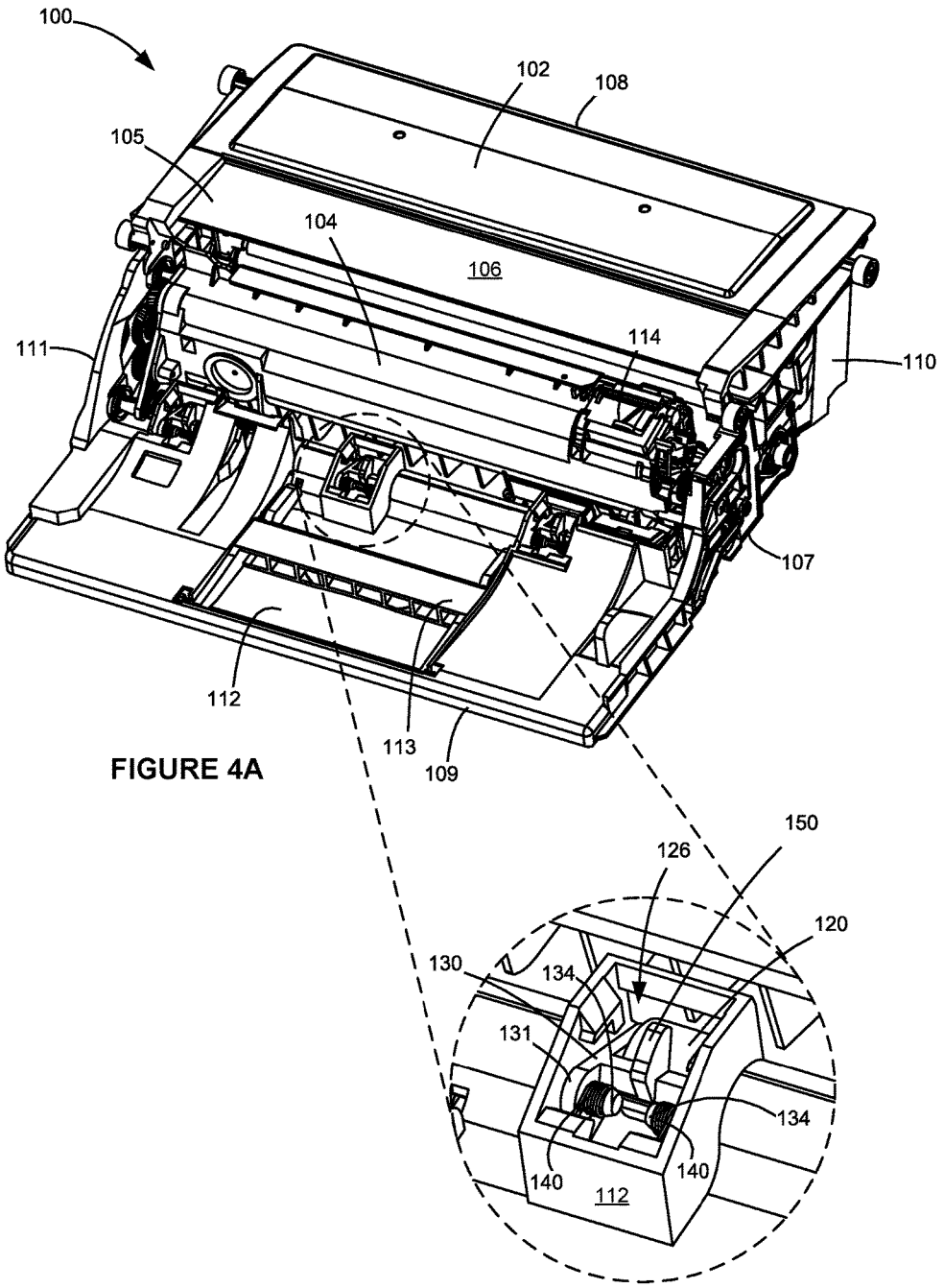
FIGS. 4A and 4B are top and bottom perspective views, respectively, of the imaging unit shown in FIG. 3.
Figure 4B:
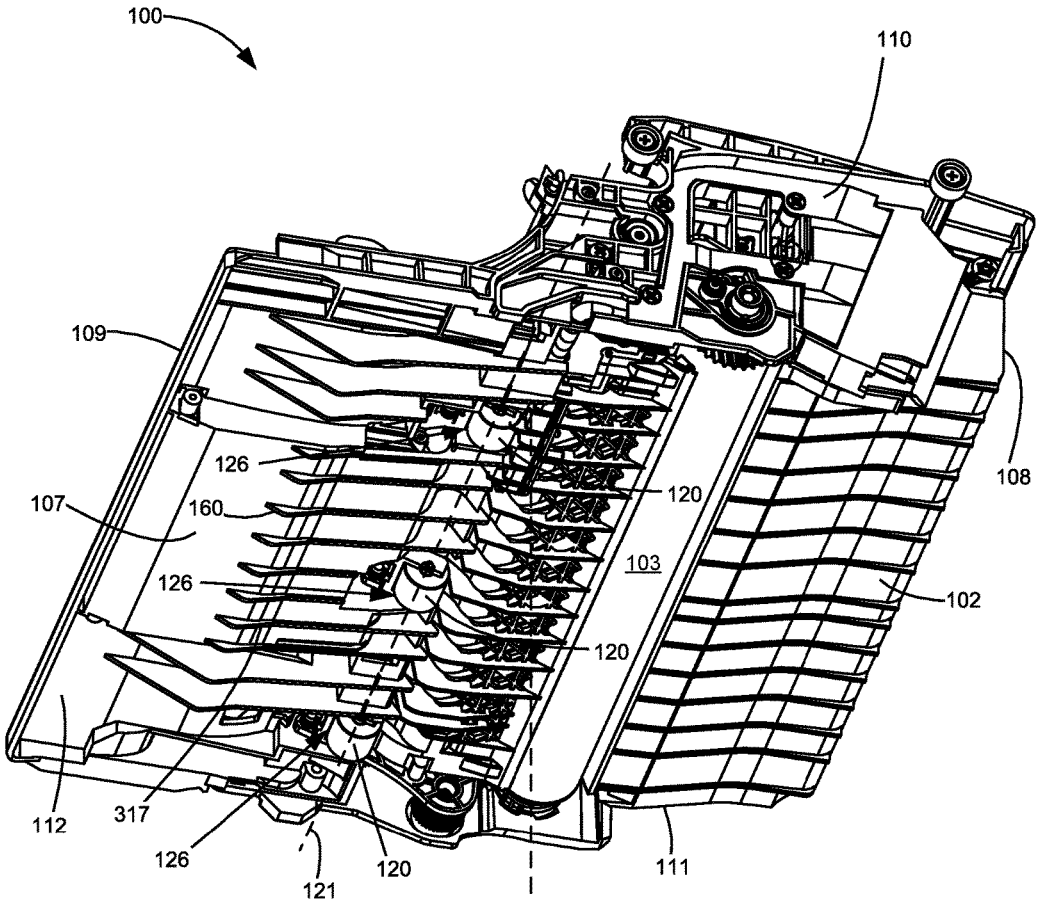

With reference to FIGS. 4A and 4B, imaging unit 100 includes one or more media feed rolls 120 positioned on housing 105. In the example embodiment illustrated, imaging unit 100 includes three media feed rolls 120 spaced from each other along a width of imaging unit 100 from side 110 to side 111, parallel to developer roll 118 and PC drum 103. In the example embodiment illustrated, media feed rolls 120 are positioned on handle frame 112 of imaging unit 100. Each media feed roll 120 is rotatable relative to housing 105 about a respective rotational axis 121.

Figure 4C:
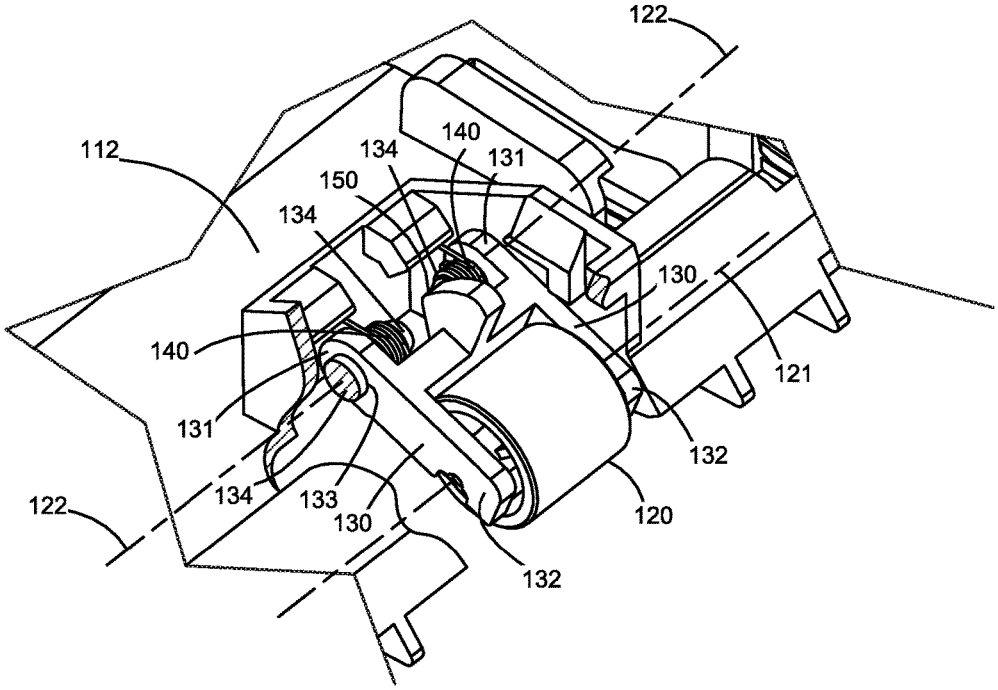
FIG. 4C is a cut-away perspective view of a media feed roll of the imaging unit shown in FIGS. 4A and 4B according to one example embodiment.

Media feed rolls 120 are exposed on bottom 107 of housing 105 through openings 126 that extend through handle frame 112. Each media feed roll 120 is pivotable relative to housing 105 between a retracted position and an operating position. FIGS. 4A and 4C show the mounting of one of the media feed rolls 120 to housing 105 in greater detail. In the example embodiment illustrated, each media feed roll 120 is substantially the same. Each media feed roll 120 is pivotable relative to housing 105 about a pivot axis 122. In the example embodiment illustrated, each media feed roll 120 is rotatably attached to a respective pivot arm 130 that is pivotally mounted to housing 105. Each pivot arm 130 includes a first end 131 and a second end 132. First end 131 of pivot arm 130 is pivotally mounted on housing 105 about pivot axis 122. In the example embodiment illustrated, one or more openings 133 in first end 131 of pivot arm 130 receive corresponding post(s) 134 that extend from handle frame 112 into opening 126. Of course, this configuration may be reversed as desired such that first end 131 of pivot arm 130 includes one or more posts that are received in corresponding opening(s) in handle frame 112. Each media feed roll 120 is rotatably mounted on second end 132 of a respective pivot arm 130 about rotational axis 121. Each pivot arm 130 includes an actuation member, such as a projection 150, that is exposed on top 106 of housing 105 through opening 126 permitting toner cartridge 200 to contact projection 150 upon toner cartridge 200 mating with imaging unit 100 to move media feed roll 120 from its retracted position to its operative position as discussed in greater detail below.

In their operative positions, media feed rolls 120 extend downward from bottom 107 of housing 105 for mating with corresponding media feed rolls 57 along media path 400 when imaging unit 100 and toner cartridge 200 are installed in image forming device 12. In their retracted positions, media feed rolls 120 are moved upward into openings 126 so that media feed rolls 120 do not interfere during insertion or removal of imaging unit 100 from image forming device 12. In some embodiments, each media feed roll 120 is biased toward its retracted position by a respective biasing member 140. As shown in FIGS. 4A and 4C, in the example embodiment illustrated, biasing member 140 includes one or more torsion springs wrapped around posts 134 and anchored against handle frame 112 and pivot arm 130 to bias media feed roll 120 upward away from bottom 107 of housing 105 toward the retracted position of media feed roll 120. However, any suitable biasing member may be used as desired, such as, for example, a compression spring, an extension spring, a material having resilient properties, etc.

With reference back to FIG. 4B, in the example embodiment illustrated, a series of media guide ribs 160 are positioned on bottom 107 of housing 105. As discussed above, bottom 107 of imaging unit 100 forms a portion of top guide surface 317 of simplex path 310 of media path 400. Media guide ribs 160 aid in guiding media sheets advancing along simplex path 310.

Figure 5:
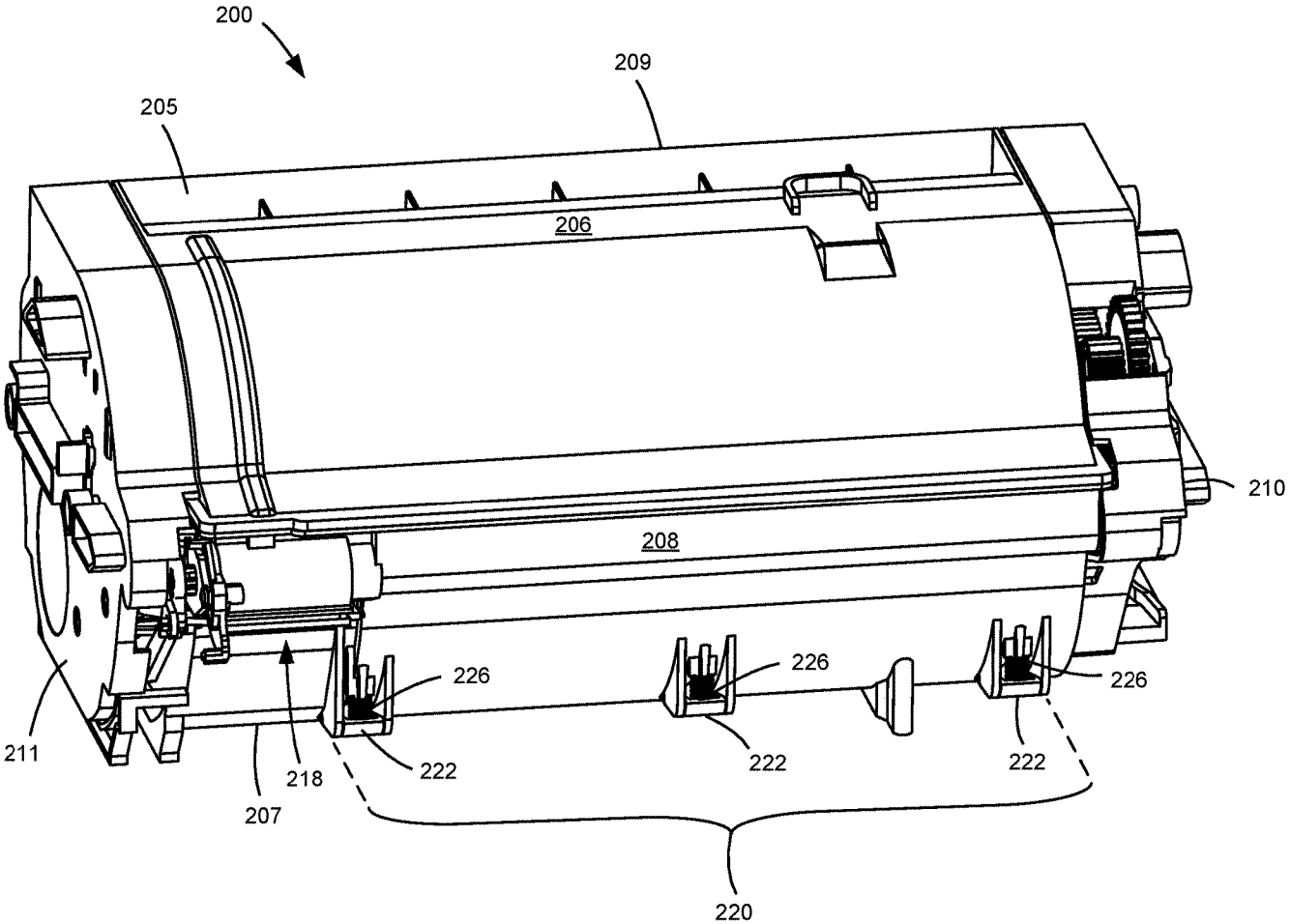
FIG. 5 is a front perspective view of the toner cartridge shown in FIG. 3.
Figure 6:
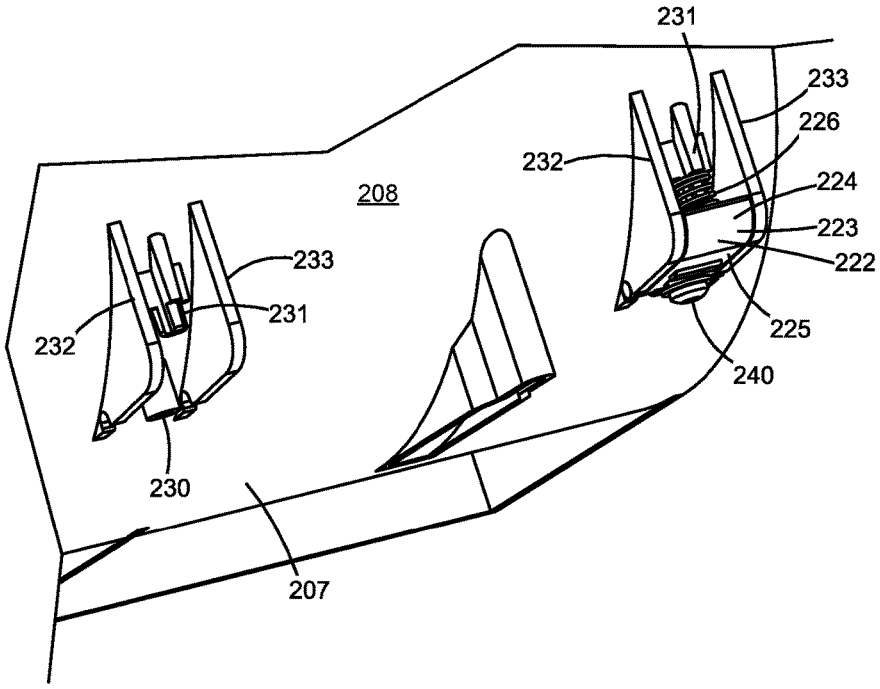
FIG. 6 is a perspective view of a biasing assembly of the toner cartridge shown in FIG. 5 according to one example embodiment.

FIG. 5 shows toner cartridge 200 according to one example embodiment having a biasing assembly 220 that moves media feed rolls 120 of imaging unit 100 from their retracted positions to their operative positions upon toner cartridge 200 mating with imaging unit 100. Biasing assembly 220 includes a respective cam 222 corresponding to each projection 150 of imaging unit 100 and positioned on front 208 of housing 205, near bottom 207 of housing 205. In the example embodiment illustrated, toner cartridge 200 includes three cams 222 spaced from each other along a width of toner cartridge 200 from side 210 to side 211. FIG. 6 shows one of the cams in greater detail as well as the mounting structure of an adjacent cam. In the example embodiment illustrated, each cam 222 is substantially the same. Each cam 222 includes a contact surface 223. Contact surface 223 includes a front portion 224 that curves downward and rearward relative to housing 205 and that leads to a bottom portion 225 of contact surface 223 that extends rearward from front portion 224 in a substantially planar manner. Each cam 222 is movable up and down as discussed in greater detail below. In some embodiments, each cam 222 is biased downward toward bottom 207 of housing 205 by a biasing member 226. In the example embodiment illustrated, biasing member 226 includes a compression spring positioned between a top surface of cam 222 and a post 231 on front 208 of housing 205. However, any suitable biasing member may be used as desired, such as, for example, an extension spring, a material having resilient properties, etc.

Each cam 222 is positioned between a respective pair of supports 232, 233 on front 208 of housing 205 that aid in retaining cam 222 on housing 205. In the example embodiment illustrated, each cam 222 is further retained against housing 205 by a fastener 240 that passes through bottom portion 225 of contact surface 223 and that is received by a mounting post 230. However, cams 222 may be secured by any suitable means.

Figure 7A:
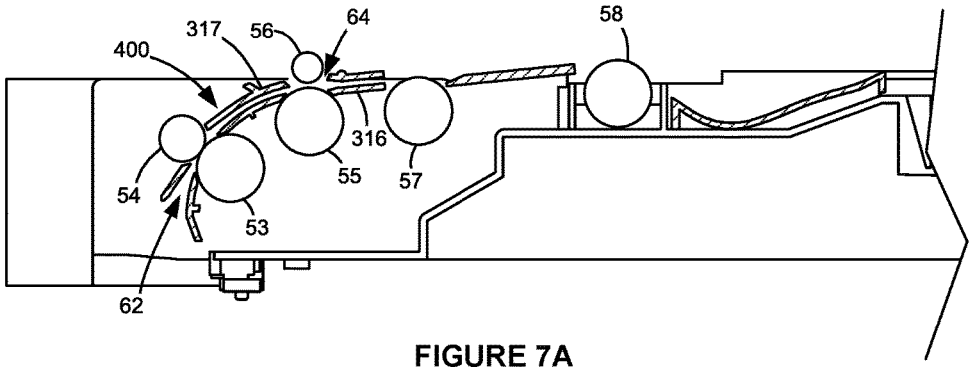
FIG. 7A is a side sectional view of a portion of the media path shown in FIG. 2 with the imaging unit and the toner cartridge removed from the image forming device.
Figure 7B:
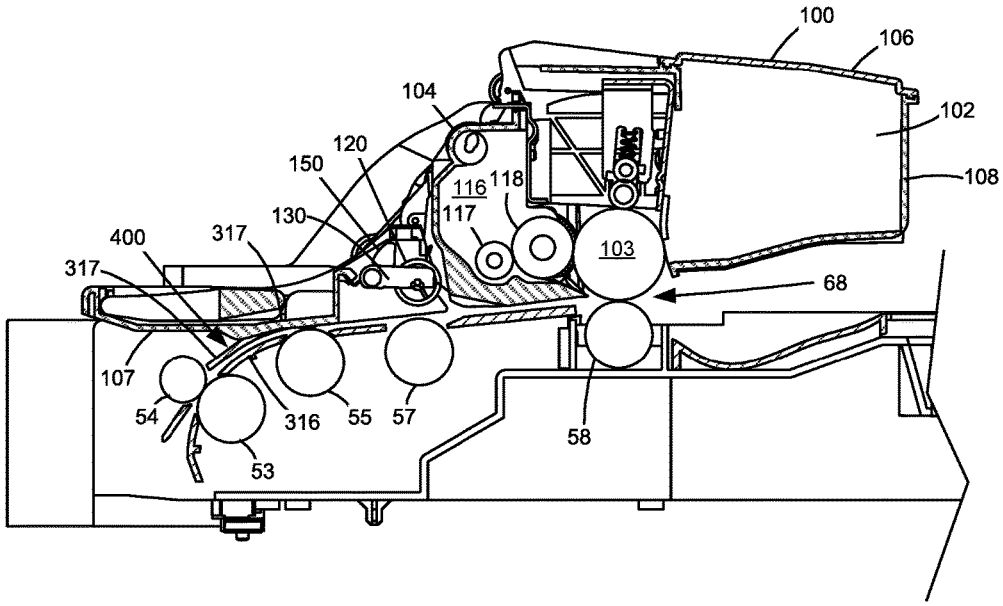
FIG. 7B is a side sectional view of the portion of the media path shown in FIG. 7A with the imaging unit installed in the image forming device.
Figure 7C:
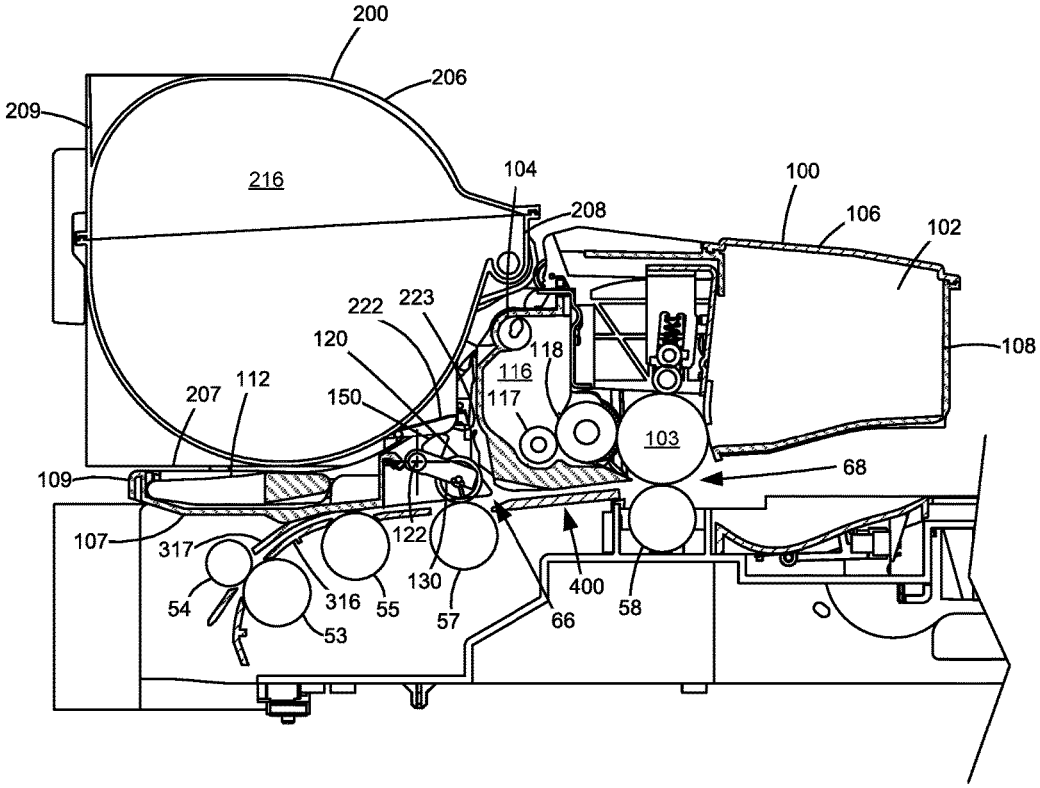
FIG. 7C is a side sectional view of the portion of the media path shown in FIGS. 7A and 7B with the imaging unit and the toner cartridge installed in the image forming device.

FIGS. 7A-7C show the sequential installation of imaging unit 100 and toner cartridge 200 along media path 400. FIG. 7A shows media path 400 without imaging unit 100 or toner cartridge 200 installed in image forming device 12. FIG. 7B shows media path 400 with imaging unit 100 installed in its operative position in image forming device 12 but without toner cartridge 200 installed in image forming device 12. FIG. 7C shows media path 400 with both imaging unit 100 and toner cartridge 200 installed in their operative positions in image forming device 12. FIGS. 7A-7C show one each of media feed rolls 53, 54, 55, 56, 57, 120 and toner transfer roll 58; however, as discussed above, each media feed roll 53, 54, 55, 56, 57, 120 and toner transfer roll 58 may include a series or set of rolls extending parallel to PC drum 103.

With reference to FIG. 7A, when imaging unit 200 and toner cartridge 100 are removed from image forming device 12, media feed roll 57 and toner transfer roll 58 are positioned along bottom guide surface 316 of simplex path 310 without corresponding media feed roll 120 and PC drum 103, respectively, such that nips are not formed at media feed roll 57 and toner transfer roll 58. Media feed rolls 53 and 55, on the other hand, are mated with media feed rolls 54 and 56 forming media feed nips 62 and 64.

With reference to FIG. 7B, when imaging unit 100 is installed in image forming device 12, bottom 107 of imaging unit 100 forms a portion of top guide surface 317 of simplex path 310 and PC drum 103 contacts toner transfer roll 58 forming toner transfer nip 68. Handle frame 112 of imaging unit 100 obscures the view of media feed roll 56 in FIGS. 7B and 7C because of the axial position of media feed roll 56. When imaging unit 100 is installed in image forming device 12 but toner cartridge 200 is not, media feed roll 120 of imaging unit 100 is in its retracted position, spaced away from corresponding media feed roll 57 in image forming device 12 as a result of the bias applied to pivot arm 130 by biasing member 140.

With reference to FIG. 7C, when toner cartridge 200 is installed in image forming device 12 and mated with imaging unit 100, cam 222 contacts pivot arm 130 causing media feed roll 120 to move from its retracted position to its operative position. Specifically, contact between contact surface 223 of cam 222 and projection 150 of pivot arm 130 as toner cartridge 200 advances to the operative position of toner cartridge 200 within image forming device 12 overcomes the bias force on pivot arm 130 causing media feed roll 120 to pivot about pivot axis 122 from the retracted position of media feed roll 120 to the operative position of media feed roll 120. In its operative position, media feed roll 120 contacts and forms media feed nip 66 with media feed roll 57 in image forming device 12 permitting media feed to toner transfer nip 68.

Figure 8A:
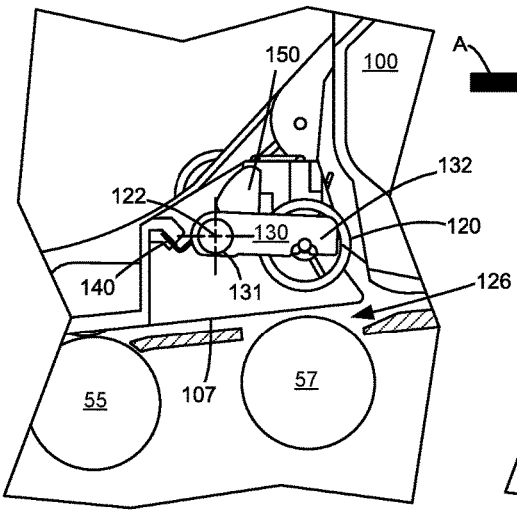
FIGS. 8A-8C are sequential side sectional views showing the biasing assembly of the toner cartridge engaging the media feed roll of the imaging unit as the toner cartridge is inserted into the image forming device according to one example embodiment.
Figure 8B:
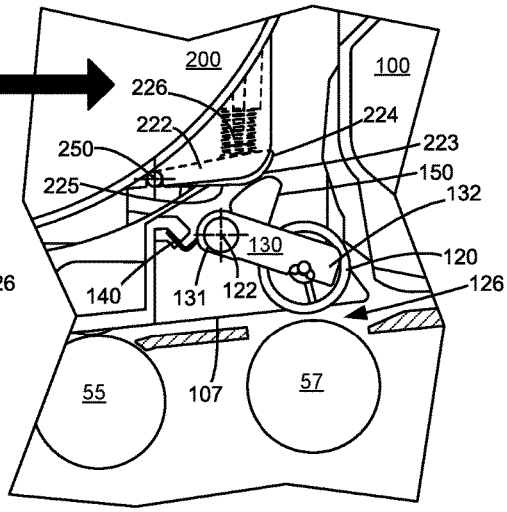
Figure 8C:
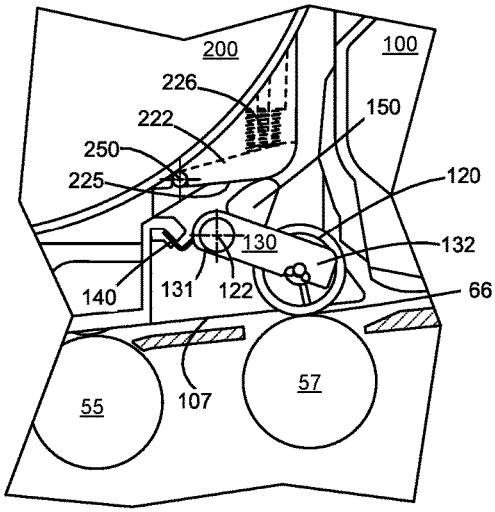

FIGS. 8A-8C are sequential views illustrating the engagement between cam 222 on toner cartridge 200 and pivot arm 130 of imaging unit 100 in greater detail. FIG. 8A shows media feed roll 120 in its retracted position within imaging unit 100 when imaging unit 100 is installed in image forming device 12 prior to installation of toner cartridge 200 into image forming device 12.

FIG. 8B shows the engagement between cam 222 of toner cartridge 200 and projection 150 of pivot arm 130 of imaging unit 100 as toner cartridge 200 is inserted into image forming device 12 along the direction of insertion indicated by the arrow A. As toner cartridge 200 advances toward imaging unit 100, front portion 224 of contact surface 223 of cam 222 contacts projection 150 of pivot arm 130 of media feed roll 120. As toner cartridge 200 continues to advance, contact between contact surface 223 of cam 222 and projection 150 overcomes the bias applied to pivot arm 130 causing media feed roll 120 to pivot downward (clockwise as viewed in FIGS. 8A-8C) about pivot axis 122 from its retracted position toward its operative position. As media feed roll 120 pivots downward, media feed roll 120 extends through opening 126 toward corresponding media feed roll 57 in image forming device 12. The contact between contact surface 223 of cam 222 and projection 150 also causes cam 222 to pivot upward (counterclockwise as viewed in FIGS. 8A-8C) about a pivot axis 250 of cam 222 against the bias applied to cam 222. As toner cartridge 200 continues to advance, bottom portion 225 of contact surface 223 contacts projection 150 causing media feed roll 120 to continue to pivot downward about pivot axis 122 and cam 222 to continue to pivot upward about pivot axis 250 until media feed roll 120 reaches its operative position.

FIG. 8C shows toner cartridge 200 fully installed in its operative position in image forming device 12 and mated with imaging unit 100 with media feed roll 120 pivoted to its operative position forming media feed nip 66 with media feed roll 57. Providing a media feed roll 120 on imaging unit 100 that is actuated by cam 222 of toner cartridge 200 permits the placement of a media feed nip 66 upstream from and in close proximity to toner transfer nip 68. Positioning media feed nip 66 in close proximity to toner transfer nip 68 permits improved control of media as it enters toner transfer nip 68 thereby improving the accuracy of the placement of toner on the media by PC drum 103 for improved print quality.

With toner cartridge 200 and imaging unit 100 in their respective operative positions within image forming device 12, engagement between cam 222 and pivot arm 130 provides a bias force to media feed nip 66. The nip force of media feed nip 66 may be optimized as desired through selection of the spring force of biasing member 140 of media feed roll 120 and biasing member 226 of cam 222.

When toner cartridge 200 is removed from image forming device 12, the sequence illustrated in FIGS. 8A-8C is reversed. As toner cartridge 200 is pulled away from imaging unit 100, media feed roll 120 returns to its retracted position as a result of the bias applied to pivot arm 130.

Figure 9:
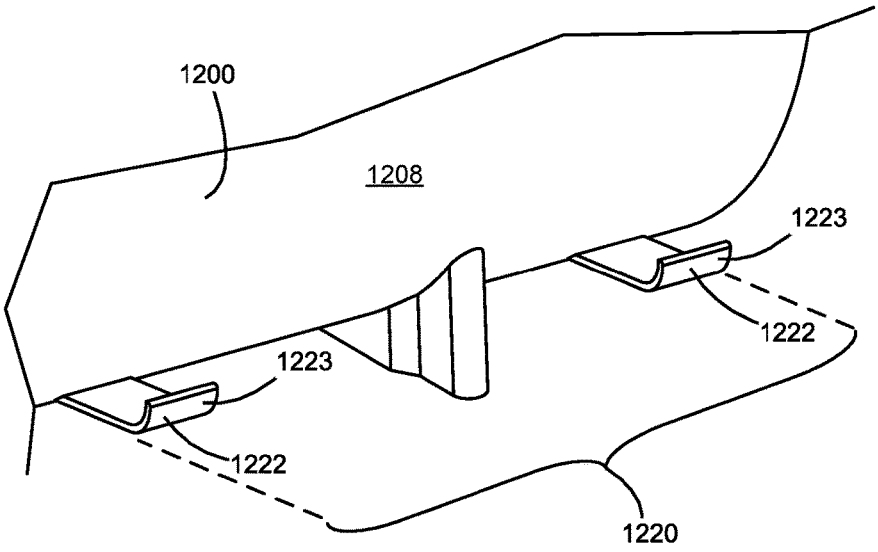
FIG. 9 is a front perspective view of a biasing assembly of the toner cartridge according to another example embodiment.

FIG. 9 shows a toner cartridge 1200 having a biasing assembly 1220 according to another example embodiment for contact and moving media feed roll(s) 120 of imaging unit 100 from their retracted positions to their operative positions upon insertion of toner cartridge 200 into image forming device 12. Biasing assembly 1220 includes one or more cams 1222 that extend from a front 1208 of toner cartridge 1200 in a cantilevered manner. Each cam 1222 includes a contact surface 1223 similar to contact surface 223 discussed above that contacts a projection 150 of a corresponding pivot arm 130 upon insertion of toner cartridge 1200 into image forming device 12 to move a corresponding media feed roll 120 from its retracted position to its operative position. Cams 1222 are resiliently deflectable upward and downward about their attachment points to front 1208 of toner cartridge 1200 permitting cams 1222 to deflect upon contacting projection 150.

While the example embodiments illustrated in FIGS. 5-6 and 9 include a resilient or compliant element on the cam(s) 222, 1222 of the toner cartridge 200, 1200, in other embodiments, toner cartridge 200 or 1200 includes one or more cam(s) positioned in a static manner on the toner cartridge and projection 150 of imaging unit 100 includes a resilient or compliant element relative to pivot arm 130. While the example embodiments discussed above include media feed roll(s) 120 positioned on imaging unit 100 that pivot from retracted positions to operative positions, it will be appreciated that the media feed roll(s) may take any suitable path of travel from their retracted positions to their operative positions, such as, for example, translating toward their operative positions. Further, while the example embodiments discussed above include actuation of media feed roll(s) 120 of imaging unit 100 to move media feed roll(s) 120 from their retracted positions to their operative positions by the advance of toner cartridge 200, 1200 into image forming device 12 during installation of toner cartridge 200, 1200 into image forming device 12, in other embodiments, media feed roll(s) 120 are moved from retracted positions to operative positions by a linkage or other engagement member of toner cartridge 200, 1200 that is actuated after toner cartridge 200, 1200 is installed in image forming device 12, such as, for example, when access door 204 is closed or upon controller 20 actuating a solenoid, motor or the like after installation of toner cartridge 200, 1200.

While the example embodiments discussed above with respect to FIGS. 2-9 include one or more media feed rolls positioned on an imaging unit and a corresponding biasing assembly positioned on a toner cartridge, in other embodiments, the toner cartridge includes one or more media feed rolls that mate with media feed roll(s) 57 in image forming device 12 to form media feed nip 66 upon installation of the toner cartridge in image forming device 12.

Figure 10:
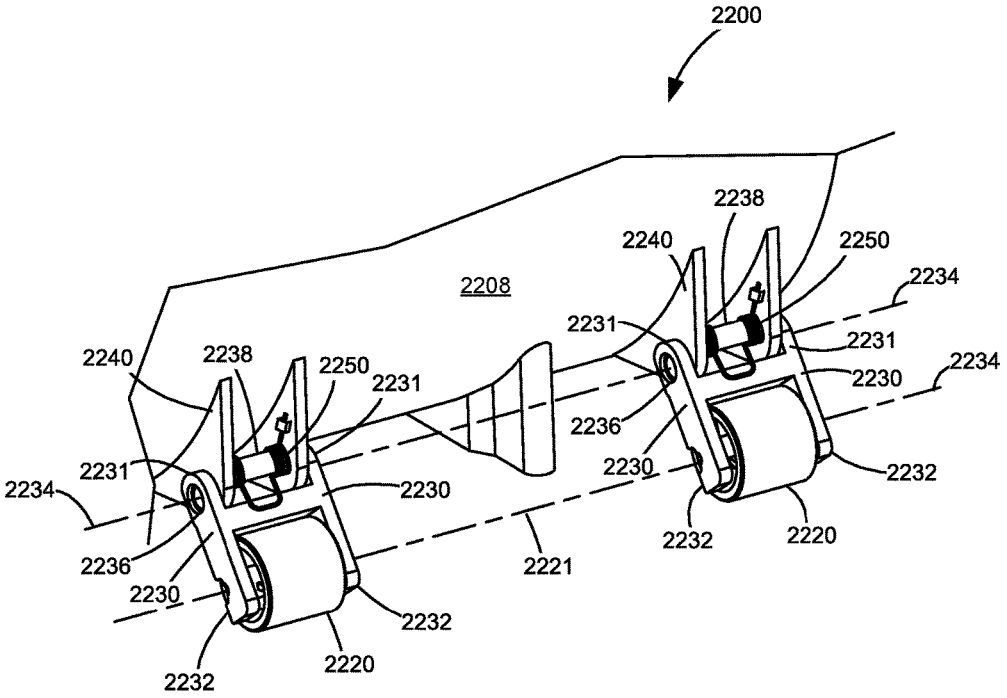
FIG. 10 is a front perspective view of a toner cartridge having a media feed roll assembly according to one example embodiment.

For example, FIG. 10 shows a toner cartridge 2200 according to one example embodiment having media feed rolls 2220 positioned on a front 2208 of toner cartridge 2200. Two media feed rolls 2220 are shown but it is understood that the number of media feed rolls 2220 may be selected as desired. Each media feed roll 2220 is rotatable about a respective rotational axis 2221. In the example embodiment illustrated, each media feed roll 2220 is rotatably attached to a respective pivot arm 2230 that is pivotally mounted to toner cartridge 2200. Each pivot arm 2230 includes a first end 2231 and a second end 2232. First end 2231 of pivot arm 2230 is pivotally mounted about a pivot axis 2234 to a support 2240 on toner cartridge 2200. In the example embodiment illustrated, one or more openings 2236 in first end 2231 of pivot arm 2230 receive a corresponding post 2238 that extends from support 2240.

In the example embodiment illustrated, each media feed roll 2220 is biased downward toward an operative position of media feed roll 2220 by a respective biasing member 2250. In the example embodiment illustrated, biasing member 2250 includes one or more torsion springs wrapped around post 2238 and anchored against support 2240 and pivot arm 2230 to bias media feed roll 2220 downward toward its operative position. However, any suitable biasing member may be used as desired, such as, for example, a compression spring, an extension spring, a material having resilient properties, etc. Pivot arms 2230 and biasing member 2250 permit media feed roll 2220 to retract upward and toward front 2208 of toner cartridge 2200 as toner cartridge 2200 is inserted into image forming device 12 so that media feed roll 2220 is able to clear handle frame 112 of imaging unit 100. Biasing member 2250 also supplies a nip force for media feed nip 66 when toner cartridge 2200 is installed in image forming device 12 and media feed roll 2220 mates with media feed roll 57.

Figure 11:
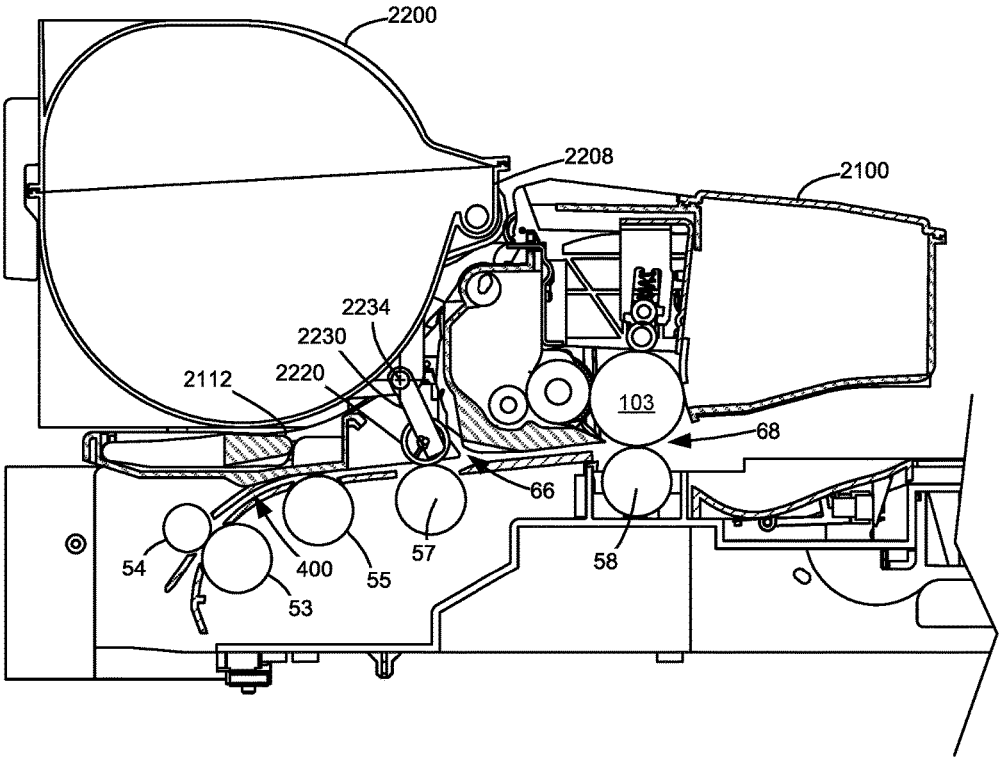
FIG. 11 is a side sectional view of a portion of the media path including the media feed roll assembly of the toner cartridge shown in FIG. 10.

FIG. 11 shows toner cartridge 2200 and a corresponding imaging unit 2100 installed in image forming device 12 along media path 400. FIG. 11 shows one each of media feed rolls 53, 54, 55, 57, 2220 and toner transfer roll 58; however, as discussed above, each media feed roll 53, 54, 55, 57, 2220 and toner transfer roll 58 may include a series or set of rolls extending axially relative to PC drum 103. During insertion of toner cartridge 2200 into image forming device 12, media feed roll(s) 2220 may contact a top surface of handle frame 2112 of imaging unit 2100 causing pivot arms 2230 to pivot upward about pivot axis 2234 allowing media feed roll(s) 2220 to clear handle frame 2112 of imaging unit 2100. As toner cartridge 2200 reaches its final position in image forming device 12 and mates with imaging unit 2100, media feed roll 2220 extends from front 2208 of toner cartridge 2200 through a corresponding opening in handle frame 2112 of imaging unit 2100 (similar to openings 126 discussed above) as a result of the bias on media feed roll(s). Media feed roll(s) 2220 extend through handle frame 2112 into contact with media feed roll(s) 57 forming media feed nip(s) 66 permitting media feed to toner transfer nip 68.

While the example embodiment shown in FIGS. 10 and 11 includes media feed roll(s) 2220 positioned on toner cartridge 2200 that pivot from retracted positions to operative positions, it will be appreciated that the media feed roll(s) may take any suitable path of travel from their retracted positions to their operative positions, such as, for example, translating toward their operative positions. In other embodiments, the media feed roll(s) may be located in fixed positions on the toner cartridge where the media feed roll(s) do not need to clear a portion of the imaging unit during insertion of the toner cartridge into the image forming device. Further, while the example embodiment shown in FIGS. 10 and 11 includes media feed roll(s) 2220 of toner cartridge 2200 that move to their operative positions automatically upon insertion of toner cartridge 2200 into image forming device 12 as a result of the bias applied to media feed roll(s) 2220, in other embodiments, media feed roll(s) 2220 are moved from retracted positions to operative positions by a linkage or other engagement member of toner cartridge 2200 that is actuated after toner cartridge 2200 is installed in image forming device 12, such as, for example, when access door 204 is closed or upon controller 20 actuating a solenoid, motor or the like after installation of toner cartridge 2200.

Although the example embodiments include a pair of replaceable units in the form of a toner cartridge and an imaging unit, it will be appreciated that the replaceable unit(s) of image forming device 12 may employ other suitable configuration as desired. For example, in another embodiment, the main toner supply for image forming device 12 and developer unit 104 are provided in a first replaceable unit and PC unit 102 is provided in a second replaceable unit. Further, although the example image forming device 12 discussed above includes one toner cartridge and corresponding imaging unit, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

It will be appreciated that the configurations of the rotatable media feed roll(s) 120, 2220 of imaging unit 100 and toner cartridge 2200, respectively, and the biasing assemblies 220, 1220 of toner cartridges 100, 1100 are not limited to the example embodiments illustrated. For example, depending on the architecture of the replaceable unit(s) of image forming device 12, the rotatable media feed roll(s) (and corresponding biasing assemblies) may be positioned at other suitable locations on the replaceable unit(s).

Further, although the example embodiments include a set of three media feed rolls positioned on the replaceable unit, it will be appreciated that any suitable number of media feed rolls may be used as desired.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge, comprising:

a housing having a reservoir for holding toner;

an outlet in fluid communication with the reservoir for exiting toner from the toner cartridge; and a resiliently deflectable cam positioned on an exterior portion of the housing to contact a media feed roll assembly when the toner cartridge is installed in an image forming device for biasing the media feed roll assembly into contact with a corresponding media feed roll in the image forming device to form a media feed nip in the image forming device.

2. The toner cartridge of claim 1, wherein the resiliently deflectable cam is positioned along a bottom portion of the housing.

3. The toner cartridge of claim 1, wherein the resiliently deflectable cam extends in a cantilevered manner from the housing.

4. The toner cartridge of claim 1, wherein the resiliently deflectable cam includes a contoured contact surface for contacting the media feed roll assembly when the toner cartridge is installed in the image forming device.

5. The toner cartridge of claim 1, further comprising a spring biasing the resiliently deflectable cam.

6. A toner cartridge, comprising:

a housing having a top, a bottom, a front and a rear positioned between a first side and a second side of the housing, the housing has a reservoir for holding toner;

an outlet in fluid communication with the reservoir and positioned on the front of the housing for exiting toner from the toner cartridge; and a projection from an exterior portion of the front of the housing near the bottom of the housing that is positioned to contact a media feed roll assembly when the toner cartridge is installed in an image forming device for biasing the media feed roll assembly into contact with a corresponding media feed roll in the image forming device to form a media feed nip in the image forming device, wherein the projection is resiliently deflectable relative to the housing.

7. The toner cartridge of claim 6, further comprising a spring biasing the projection.

8. The toner cartridge of claim 6, wherein the projection extends in a cantilevered manner from the housing.

9. The toner cartridge of claim 6, wherein the projection includes a contoured contact surface for contacting the media feed roll assembly when the toner cartridge is installed in the image forming device.

10. An imaging system for an electrophotographic image forming device, comprising:

a toner cartridge removable from the image forming device, the toner cartridge including:

a housing having a reservoir for holding toner;

an outlet on the housing of the toner cartridge in fluid communication with the reservoir for exiting toner from the toner cartridge; and an engagement member positioned on an exterior portion of the housing of the toner cartridge; and an imaging unit matable with the toner cartridge when the toner cartridge and the imaging unit are installed in the image forming device and removable from the image forming device separately from the toner cartridge, the imaging unit including:

a housing;

an inlet on the housing of the imaging unit positioned to receive toner from the outlet of the toner cartridge when the toner cartridge is mated with the imaging unit; and a rotatable media feed roll mounted on the housing of the imaging unit, wherein when the toner cartridge mates with the imaging unit with the toner cartridge and the imaging unit installed in the image forming device, the engagement member of the toner cartridge moves the media feed roll of the imaging unit relative to the housing of the imaging unit from a retracted position of the media feed roll to an operative position of the media feed roll where the media feed roll mates with a corresponding media feed roll in the image forming device to form a media feed nip with the corresponding media feed roll in the image forming device, wherein the engagement member includes a resiliently deflectable cam on an exterior portion of the housing of the toner cartridge that contacts an actuation member that is operatively connected to the media feed roll of the imaging unit when the toner cartridge mates with the imaging unit with the toner cartridge and the imaging unit installed in the image forming device.

11. The imaging system of claim 10, wherein the media feed roll of the imaging unit is biased toward the retracted position.

* * * * *